US007251916B2

(12) United States Patent
Konzelmann et al.

(10) Patent No.: US 7,251,916 B2
(45) Date of Patent: Aug. 7, 2007

(54) PANELS COMPRISING AN INTERLOCKING SNAP-IN PROFILE

(75) Inventors: Karl-Heinz Konzelmann, Lampertswalde (DE); Maik Moebus, Lampertswalde (DE)

(73) Assignee: M. Kaindl, Salzburg (AT)

( * ) Notice: Subject to any disclaimer, the term of this patent is extended or adjusted under 35 U.S.C. 154(b) by 422 days.

(21) Appl. No.: 10/480,903

(22) PCT Filed: Oct. 25, 2001

(86) PCT No.: PCT/EP01/12359

§ 371 (c)(1),
(2), (4) Date: Dec. 15, 2003

(87) PCT Pub. No.: WO02/103135

PCT Pub. Date: Dec. 27, 2002

(65) Prior Publication Data

US 2004/0168392 A1 Sep. 2, 2004

(30) Foreign Application Priority Data

Jun. 17, 2001 (DE) ..... 201 09 840 U

(51) Int. Cl.
*E04B 2/32* (2006.01)

(52) U.S. Cl. ..... 52/592.1; 52/591.1

(58) Field of Classification Search ..... 52/592.1, 52/586.2, 590.2, 590.3, 591.1, 591.4, 592.2
See application file for complete search history.

(56) References Cited

U.S. PATENT DOCUMENTS

| | | | | |
|---|---|---|---|---|
| 4,426,820 | A | 1/1984 | Terbrack et al. | |
| 5,295,341 | A | 3/1994 | Kajiwara | |
| 6,006,486 | A * | 12/1999 | Moriau et al. | 52/589.1 |
| 6,247,285 | B1 | 6/2001 | Moebus | |
| 6,601,359 | B2 * | 8/2003 | Olofsson | 52/588.1 |
| 6,786,019 | B2 * | 9/2004 | Thiers | 52/589.1 |
| 2002/0170258 | A1 * | 11/2002 | Schwitte et al. | 52/592.1 |
| 2003/0009971 | A1 * | 1/2003 | Palmberg | 52/578 |
| 2003/0029117 | A1 * | 2/2003 | Moriau et al. | 52/592.1 |

FOREIGN PATENT DOCUMENTS

| | | |
|---|---|---|
| AT | 405 560 B | 9/1999 |
| CA | 991373 | 6/1976 |
| CA | 2363184 | 7/2001 |
| CH | 562 377 | 5/1975 |
| DE | 25 02 992 A1 | 7/1976 |
| DE | 200 01 788 U1 | 6/2000 |
| EP | 843763 | 5/1998 |
| EP | 0906994 A1 | 4/1999 |

(Continued)

*Primary Examiner*—Richard E. Chilcot, Jr.
*Assistant Examiner*—Jessica Laux
(74) *Attorney, Agent, or Firm*—Pearne & Gordon LLP

(57) ABSTRACT

Panels or boards comprise laterally mounted locking elements that can be inter-connected laterally in a positive fit, without the use of adhesive. The locking elements are designed to be connected in an initial position in which the panels are interlocked at least in one direction in a positive fit and a certain amount of play occurs in the common joint of the two panels. The panels may then be shifted, in a parallel direction relative to the common joint, to final position in which there is no play in the common joint and the panels are interconnected without the use of adhesive.

6 Claims, 2 Drawing Sheets

FOREIGN PATENT DOCUMENTS

| | | | |
|---|---|---|---|
| GB | 1430423 | | 3/1976 |
| GB | 2256023 | A | 11/1992 |
| WO | WO 94/02699 | A1 | 2/1994 |
| WO | WO 94/26999 | | 11/1994 |
| WO | WO 96/27721 | | 12/1996 |
| WO | WO 97/47834 | | 12/1997 |

* cited by examiner

FIG. 1
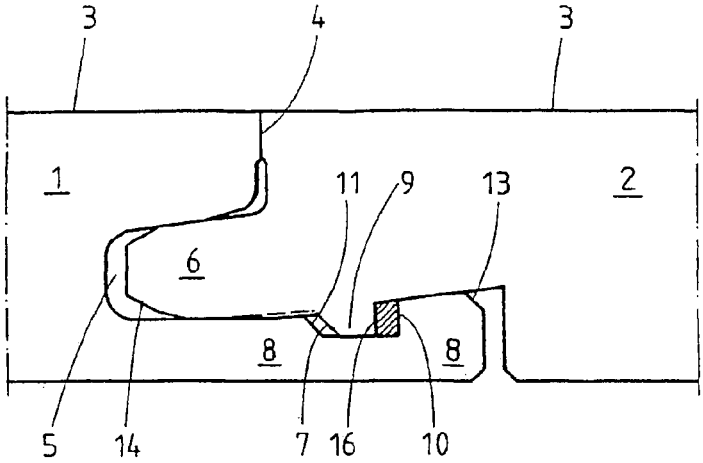
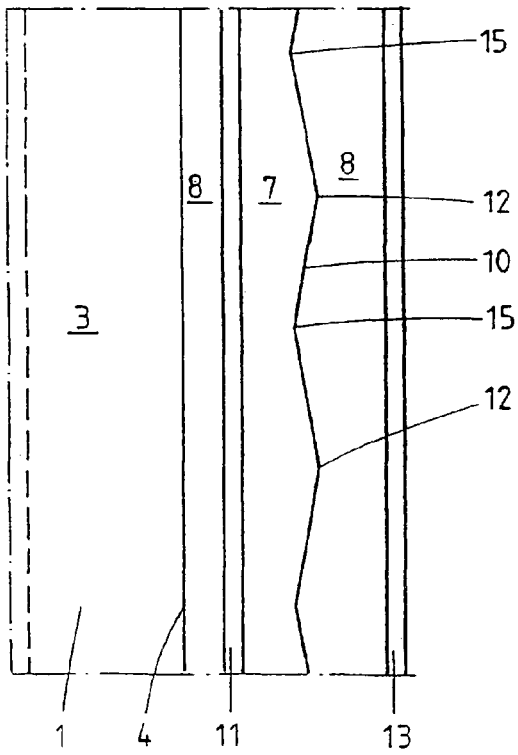
FIG. 1A
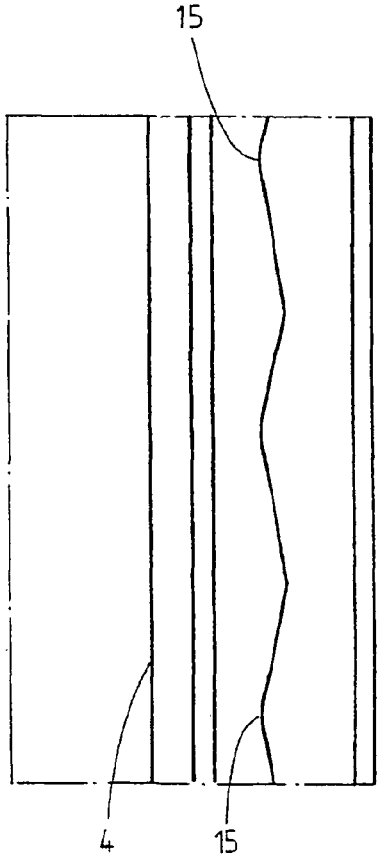
FIG. 1B

PANELS COMPRISING AN INTERLOCKING SNAP-IN PROFILE

CROSS-REFERENCES TO RELATED APPLICATIONS

The present application is a national phase of International Application No. PCT/EP01/12359, filed Oct. 25, 2001, which claims the priority of German Patent Application No. 201 09 840.7, filed Jun. 17, 2001.

BACKGROUND OF THE INVENTION AND RELATED ART

The invention relates to boards having laterally mounted locking elements as well as to installing them.

A board of the kind mentioned at the beginning is known from printed publication EP 090 6994 A1 as "panel". As a rule, a panel is an oblong, thin board which can be connected laterally with further panels, i.e. on its longitudinal and transverse sides, e.g. by means of tongues and grooves. Panels connected in this manner are being used particularly as floor coverings or wall coverings.

The connected panels are, for example, put together to form a floor covering known as laminate flooring. The panels comprise a carrier board made from a derived timber product as well as a decorative paper on the top side together with a protection against abrasion.

In order to avoid having to use adhesive, a plug-in profile for a panel is known from printed publication WO 96/27721, which, first of all, comprises tongues and grooves in the known manner. Moreover, each tongue has, at one top side and/or bottom side, at least one continuous protruding locking element. Each groove is provided with furrows in such a way that the protruding locking element arrives in the corresponding furrow when two panels have been snapped together. Thus, a connection between two panels without the use of adhesive is established, brought about by means of a positive fit.

The use of adhesive is not required for assembling a flooring or wall covering from the panels. Of course, it is nevertheless possible, and in some cases—such as in the case of the present invention—advantageous to also use adhesive.

It is known from printed publication WO 96/27721 to connect two panels by shifting in one plane or by a rotary movement around the joint which is located between the two panels.

Furthermore, connections between two panels without the use of adhesives which are effected by lowering, are known from printed publication OS 25 02 992. After lowering, the boards are connected in a positive fit.

The idea of connecting two boards by positive fit without the use of adhesives has been known for several decades, as can be seen from printed publications GB 1 430 423 or U.S. Pat. No. 5,295,341. Particularly with regard to the area of the floor, the joints between two panels should not, for reasons of appearance and hygiene, exhibit any play, so that high demands must made be with regard to production tolerances. At present, production tolerances should not exceed 1/10th of a millimeter. Only in recent years, these production tolerances were successfully realized in practice. Therefore, it has only become possible in the last two years to successfully sell panels for floor coverings which can be connected without the use of adhesives.

Since the panels are manufactured from wood or from a derived timber product, the material warps even after production has been completed. The panels may warp to an extent which makes laying them practically impossible.

The invention is rooted in the problem of providing boards which can be connected without the use of adhesives, which do not exhibit play in the connecting joint after laying is completed and for which the demands with regard to the production tolerances are low in comparison with the above-mentioned state of the art.

The problem is solved by means of a board having the characterizing features of the first claim. Advantageous embodiments result from the dependent claims.

SUMMARY OF THE INVENTION

A board according to the claims comprises laterally mounted locking means with which two panels may be interconnected laterally in a positive fit without the use of adhesives. A connection between two panels without the use of adhesives is present when, by positive fit, they are interconnected 1. in a vertical direction relative to the board's surface and
2. in a parallel direction relative to the board's surface and at the same time in a vertical direction relative to the common connecting joint.

In contrast to the state of the art, the locking elements are designed in such a way that though the boards or panels, in an initial position, are interlocked at least in one direction by positive fit, there is play in the common joint. Because of the play, the boards may be pulled apart to a small extent (corresponding to the extent of play), namely in a vertical direction relative to the joint, and subsequently may again be pushed together to a small extent—in a vertical direction relative to the joint. Furthermore, the locking elements are designed in such a way that a final position with no play between the boards or panels is reached only after subsequent shifting. In the final position, therefore, the aforementioned shifting as a result of a play is no longer possible.

Since the connection between the two panels, in the initial position, exhibits play, it is not necessary to comply with the high degree of production accuracy mentioned at the beginning in order to join them. Joining can be successfully achieved even if the boards are slightly warped.

Subsequently, two boards or panels are shifted, in particular in a substantially parallel direction relative to the common joint until the final position is reached. Then, there is no more play at the joint. The locking elements are designed for this purpose.

The invention does not require a high degree of accuracy in production in order to establish a connection without the use of adhesives between two boards, since, at least in one direction, a locking means having sufficient play is present.

Preferably, there is an initial position in which the panels are locked in both aforementioned directions in a positive fit, and thus are already interconnected without the use of adhesive. In contrast to the state of the art, the locking elements are furthermore designed in such a way, so that, by shifting, play which is still evident in the initial position disappears between the joints.

Thus, the desired goals are realized, namely a reliable connection without the use of adhesives which is not affected by inaccuracies in production on the one hand, and avoidance of play in the connecting joint on the other hand.

It will be explained by means of the embodiments described below, why play can be avoided, regardless of the inaccuracies in production.

BRIEF DESCRIPTION OF THE DRAWINGS

FIG. 1 is a schematic, fragmentary sectional view of a connecting joint securing boards together in accordance the present invention;

FIG. 1A is a fragmentary top plan view of one of the boards of FIG. 1;

FIG. 1B is a fragmentary view similar to FIG. 1A showing a modification of the connecting joint in accordance with the invention;

DETAILED DESCRIPTION OF THE PREFERRED EMBODIMENTS

Figure 2:
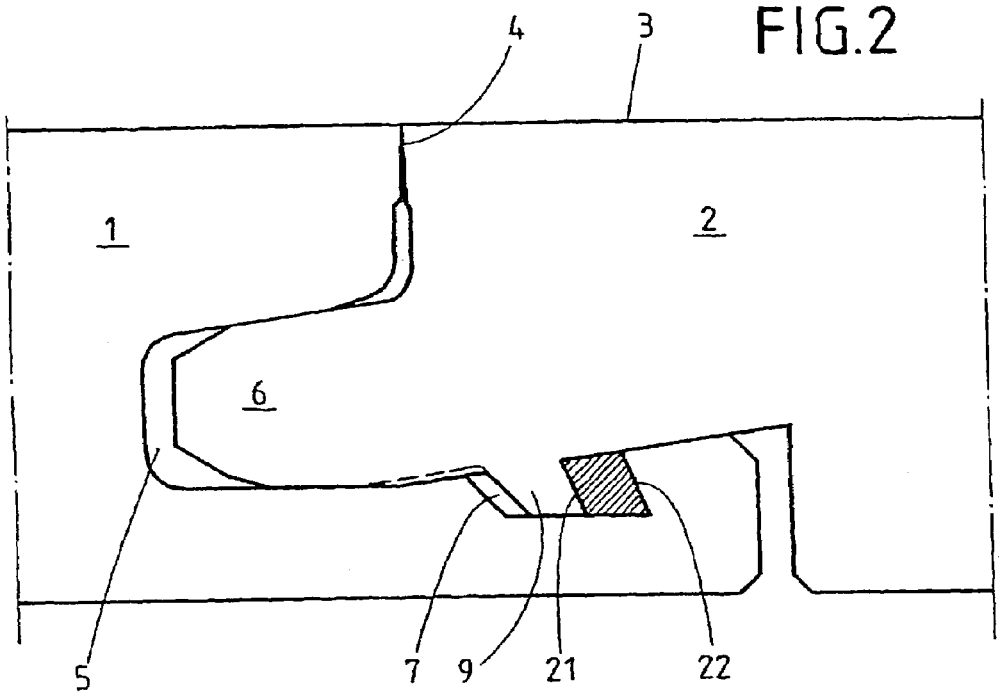
FIG. 2 is a schematic, fragmentary sectional view similar to FIG. 1 showing a second embodiment of a connecting joint in accordance with the present invention.

In one embodiment of the invention, a board has, at the sides, a groove and/or a tongue. The tongue protrudes in a lateral direction, parallel to the surface of the board. The groove has, e.g., been milled in laterally, parallel to the surface of the board. By pushing a tongue of a first board into the aforementioned groove of a second board, the two boards are interconnected in the known manner so that they are interlocked, in a vertical direction relative to the surface, because of positive fit.

The boards have further locking elements which make possible the connection by positive fit, in a parallel direction relative to the surface as well as in a vertical or perpendicular direction relative to the connecting joint. In general, this is a second groove which has been, e.g. milled in a vertical direction to the surface. The second groove may be provided at the bottom side of a board or in the first-mentioned groove. From FIG. 1 of printed publication WO 94/26999, it is known to provide the grooves at the bottom side of the board.

The other board is provided with at least one corresponding locking element, which arrives in the second groove when the boards are interlocked. According to the FIG. 1 of printed publication WO 94/26999, a locking strip protruding over the joining edge is provided for this purpose, at the end of which locking strip the protruding locking element is mounted. When the corresponding protruding locking element arrives in the second groove, the two boards are interconnected, also by positive fit, so that the boards cannot be separated from each other by shifting in a vertical plane relative to the common joint. In this initial position, the aforementioned play is present Such play is described, e.g., in printed publication WO 94/26999 and identified, in FIG. 1*a*, by "Δ". Furthermore, such play is known from FIG. 4 of printed publication GB 2 256 023 A.

According to the invention, the second groove or the corresponding lateral border runs so that shifting the boards in a direction parallel to the joint has the effect of simultaneously moving one board towards the other board.

This movement takes place until there is no play any longer.

The aforementioned run is preferably realized by the lateral walls of the second groove running in a wavelike, serpentine or sawtooth-like way. The breadth of the groove may narrow. The essential point of this embodiment is that the distance between the second groove and the adjoining joint varies. In an embodiment similar to the figures in printed publication WO 94/26999, the distance between the joint and the wall of the groove closer to the joint than the other wall of the groove is of essence.

In this embodiment, the boards or panels are at first connected so that the one or more protruding locking elements arrive in the second groove at a location near to the connecting joint. If one of the two panels is now shifted in a direction parallel to the common joint, which is referred to as connecting joint, the protruding locking element at last arrives at areas of the second groove which have a greater distance from the connecting joint. Thus, the boards simultaneously move toward each other, automatically in a way, until at last, play is eliminated. The final position has been reached.

In a further embodiment of the invention, the first-mentioned groove comprises a protruding flank or lip. At the end of the protruding flank or lip, at least one protruding locking element is located which arrives in the second groove when the two boards are connected.

The aforementioned initial position can be made available by a rotary movement around the connecting joint. If the protruding lip is elastic, the boards may also be connected by shifting in one plane. Boards which are connected by shifting in one plane are the subject matter of patents EP 843 763 B1 and GB 1 430 423.

As a rule, a substantially inelastic protruding lip is to be preferred, since then, the interlock is particularly sturdy. This case is shown e.g. in FIG. 18 of printed publication U.S. Pat. No. 4,426,820. In this case in particular, the protruding locking element of the one board is located outside of the first-mentioned groove. The lower lip protrudes to a corresponding amount, in comparison to the one situated above it. The second groove of the other board in places then nears the connecting joint so far that the one or more protruding locking elements arrive in the second groove by lowering the second groove of the one board in the direction of the one or more protruding locking elements of the other board. An interlock by positive fit, in a direction parallel to the surface and vertical to the connecting joint, is established. Such an interlock is not yet established in the vertical direction.

When the shifting movement is subsequently carried out in a direction parallel to the connecting joint, the two boards near each other. The first-mentioned laterally protruding tongue then arrives in the first-mentioned laterally milled groove.

It is only now that a vertical interlock is also established. Prolonging the shifting movement finally leads to play no longer being present in the connecting joint.

This embodiment is particularly easy to handle. Laying does not present a problem even if several oblong panels are already connected at their narrow side and are then to be collectively connected to a row of panels which have already been laid. Here, the invention shows substantial advantages with regard to handling, compared to panels capable of being interconnected without the use of adhesive, which, at their narrow sides, have to be connected by a rotary movement, on account of e.g. an inelastic protruding lip, before the longitudinal sides are connected in the same manner by a rotary movement. Such a state of the art with these disadvantages can be seen in printed publication U.S. Pat. No. 4,426,820.

In another embodiment of the invention, additional grooves may branch off from the second groove in the direction of the connecting joint and end there. Protruding locking elements may then be pushed from the outside in the direction of the second groove through these branchings. When these are level with the second groove, the boards are pushed in a parallel direction relative to each other until the aforementioned initial position is reached. Further pushing results in the final position being reached.

This embodiment of the invention is advantageous in a case where, at first, several panels are connected in this manner in order to form a row.

For oblong panels, this is the case when the narrow sides are connected first. The interconnection at the narrow edges may be a connection without the use of adhesives according to the state of the art. Preferably, this may be a connection comprising a protruding lower inelastic lip or flank, since such connections are particularly sturdy. Also, the connecting joint is relatively short here, making inaccuracies in production less problematic. The longitudinal sides are then interconnected by shifting within one plane. At last, a particularly sturdy connection without the use of adhesives is established. Handling is very easy.

If panels are interconnected at their longitudinal sides first, the connections at the narrow sides are designed in a manner which allows connecting without the use of adhesives by shifting in one plane. Such a state of the art can be seen from patent AT 405 560 B. This state of the art discloses a laterally milled groove with two elastic flanks of equal length. The flanks form the lateral walls of the groove. On a further panel, a tongue is provided laterally. The tongue has, in particular at its bottom side, a protruding locking element. Alternatively or in addition, the protruding locking element may be provided on the top side. Corresponding to this protruding locking element, there is, within the aforementioned lateral groove, an additional, second groove which is provided in one of the two flanks of the groove. The protruding locking element snaps into the secondly-mentioned groove, When the panels are interconnected by shifting in one plane.

If the tongue is provided with one protruding locking element each on the bottom and on the top side, the lateral groove is provided, correspondingly, with one additional groove each in the upper and the lower flank.

The additional groove which is located in the flank of the first-mentioned groove, together with the protruding locking element on the top or bottom side of the tongue, effects the connection in a positive fit in a direction parallel to the surface of the panels as well as vertical to the connecting joint. Preferably, such an additional or second groove is only provided in the lower flank. Accordingly, the corresponding protruding locking element is then provided at the lower side of the flank. It has turned out that a protruding locking element at the top side of the tongue, together with the corresponding groove, impairs the appearance of the panel's surface. It may easily happen that the protruding locking element may, for example on account of inaccuracies in production, exert a pressure which causes a kind of dent in the surface. According to the invention, a panel is thin if its thickness does not exceed 14 mm, in particular, if its thickness does not exceed 10 mm.

In a further embodiment, the aforementioned connection which is intended especially for the narrow sides of an oblong panel is provided with an additional laterally placed upper groove in the panel together with a laterally placed corresponding upper tongue in another panel.

The upper groove is located above the tongue with the protruding locking element. In correspondence to this, the upper tongue is located above the first-mentioned groove. Therefore, it is a "double tongue-and-groove" connection which interlocks two panels by positive fit in a vertical direction relative to the surface. The upper groove has a lesser depth than the first-mentioned groove, which is located under the upper tongue. Accordingly, the upper tongue is shorter in comparison with the tongue which is located under the upper groove. For narrow sides, this connection has been seen to be especially sturdy. If, additionally, adhesive is applied to the lateral connection or if the lateral connection is already provided in the factory with an adhesive which is not activated until laying or afterwards, for example by pressure or heating, a particularly large contact area is provided.

Preferably one or more recesses for receiving excess adhesives are provided if the application of adhesives for the double tongue-and-groove connection is intended. By means of the recesses, cavities within the connecting joint are provided. Such a cavity is particularly intended to be located between the upper tongue-and-groove connection and the one below it. In addition, one or all grooves are preferably deeper than the corresponding tongue, so that a cavity remains between the end of the tongue and the bottom of the groove. A connecting joint may additionally be provided with a recess on the bottom side of the panels below the first groove and the first tongue.

In the following, we will again go into details of an embodiment of the connection which is referred to in the first claim. The second groove is milled in from underneath into a board. The lateral wall of the second groove which is located nearest to the connecting joint, preferably is at least partially shaped like an arch. The arch then runs so that the "center of the arch" is "enclosed" by the connecting joint and the arch. This means that, in the aforementioned final position, the protruding locking element is located in an area of the second groove, which at least approximates a parallel run, relative to the joint, of the groove. This is to counteract an unintended slipping back in the direction of the initial position.

Preferably, the adhesive is applied in the factory and will only be activated by pressure or heating. The adhesive may, for example, be applied in an encapsulated form in the second groove, namely where the protruding locking element will presumably arrive in the final position. As soon as this is the case, the capsule is destroyed by the resulting pressure and the elements are glued together.

Alternatively, components of a two-component adhesive may be applied to two protruding locking elements and two grooves. The different components are then mixed in the final position.

By means of the adhesive, cohesion is improved on the one hand, while on the other hand, the connecting joints are protected from the ingress of moisture. If moisture protection is the main objective, a water repellent paste or tacky mass may be provided instead of the adhesive. Basically, such a water repellent paste or tacky mass is suitable for any connection without the use of adhesives in order to prevent the ingress of moisture into the connecting joints and the ensuing damage.

The contact area or the wall which form the contact area between the protruding locking element and the corresponding groove, preferably run in a vertical direction relative to the surface of the boards. For the purpose of illustration, the subject matter of patent EP 843 763 B1 is referred to. Here, the contact area is oblique. The obliqueness of the contact area is a disadvantage especially in case of an elastic flange or protruding lip of a groove, the disadvantage being that a panel may also slip out again if under strain. This disadvantage is avoided by means of the vertical contact area. In the subject matter of the patent, an oblique contact area is required in order to be able to connect two panels at the connecting joint, even without play being present. Even through a vertical contact area is known from printed publication WO 94/26999, as can be seen in FIG. 1*a*, this state of the art, however, discloses the vertical contact area always in a combination with play.

It would not have been possible to connect two panels with the aforementioned vertical contact areas without such a play. Since, according to the invention, there is, at first, play in the initial position it is possible to connect two boards or panels in spite of vertical contact areas. An oblique contact area including with the aforementioned disadvantages can therefore be avoided without having to accept play in the connecting joint.

In a further embodiment of the invention, the walls forming the contact area are even undercut. The contact area then again has an incline relative to the surface, but this incline runs in the opposite direction, compared to the oblique contact area included in the subject matter of patent EP 843 763 B1. By means of this incline in the opposite direction, an indenting is effected in the final position, so that just by this means, a connection without the use of adhesives according to the invention is being made available.

If a paste, a pressure-sensitive adhesive or a tacky mass are used as sealant, two interconnected panels are not firmly glued together, but may subsequently be separated from each other again without problems. Also, the paste or tacky mass can be applied directly before laying to the locking elements and/or lateral edges of a panel. If the paste or tacky mass wells out of the joints or connecting joints during the process of laying, this excess paste or mass may be removed without any difficulties from the surface, without any residue remaining.

At the same time, the joint is reliably sealed, so that no moisture may ingress into the joint from the direction of the (floor's) surface. Thus, sealing up to the upper edge is successfully effected without impairing the appearance of the surface by sealant residue. It is even of advantage to apply excess paste or mass to the locking elements and/or lateral edges, since then, the excess paste or mass wells up from the surface when the panels are laid. In this manner, it is assured that the joints between the panels are sealed exactly up to the surface.

Thus, problems with moisture can be avoided particularly inexpensively in the case of panels which can be connected without the use of adhesives. Such panels which can be connected by positive fit and thus without the use of adhesives are available on the market in different designs. With regard to panels which can be connected by positive fit (for example such panels which have locking elements according to the first claim), it was always necessary, at the state of the art, to manufacture them in a way which kept the swelling down to a small amount in order to counteract moisture problems. The moisture problem looms especially large with regard to panels which can be connected by positive fit, since moisture may ingress in the joints because of the lack of adhesives. In order to reduce the swelling properties, it was necessary in the past to provide a high content of melamine resin for panels which can be connected in positive fit.

Melamine resin is a large cost factor in the manufacture of panels. The content of melamine resin in the manufacture of panels can be significantly reduced if a paste, a tacky mass or pressure-sensitive adhesive is used. In this way, it is even possible to use less expensive panels.

By means of the following figures, an embodiment of the invention will be illustrated.

Referring to FIGS. 1 and 1A, two boards, 1 and 2, are depicted which are provided with laterally mounted locking elements. The locking elements connect the boards 1 and 2 without the use of adhesives. According to FIG. 1, the boards 1 and 2 are connected or interlocked, by a positive fit, in a vertical direction relative to the surface 3 of the boards 1 and 2, as well as in a direction parallel to the boards'surface 3. Furthermore, the two boards 1 and 2 are interlocked in a vertical direction relative to the common connecting joint. A shifting of board 1 relative to board 2, in a direction parallel to the connecting joint 4, is possible to a limited extent.

At the common joint 4, there may be play. Because of the play, the boards may be pulled apart to a small extent (corresponding to the amount of play), namely in a vertical direction relative to the connecting joint 4 and in a parallel direction relative to the surface 3. The locking elements according to FIG. 1 are made in a such a manner, that starting from an initial position, a final position is reached by shifting in a parallel direction relative to the connecting joint, in which final position there is no play between the boards (or panels) 1 and 2.

As a first locking element, board 1 has a lateral groove 5. Groove 5 is, for example, milled in laterally, in a parallel direction relative to the surface of board 1. Board 2 has, as a first locking element, a lateral tongue 6. Tongue 6 protrudes laterally in a parallel direction relative to the surface 3 of board 2.

By pushing the tongue 6 of the board 2 into the aforementioned groove 5 of board 1, the two boards 1 and 2 are interconnected in a known manner, so that they are interlocked by positive fit in a vertical direction relative to the surface 3.

The boards 1 and 2 have further locking elements which allow the connection by positive fit in a parallel direction relative to surface 3 as well as in a vertical direction relative to the connecting joint 4. This is a second groove 7, which has been milled in, in a vertical direction relative to the surface 3, into a lower protruding lip or flank 8 of the groove 5. Groove 7 therefore constitutes a further locking element of the board 1.

On the other board 2, there is a protruding locking element 9 which corresponds to groove 7, and which—as shown in FIG. 1—has arrived in the second groove 7 when the boards 1 and 2 are interlocked. In that case, the two boards 1 and 2 are connected by positive fit so that the boards cannot be separated from each other by shifting in a plane which is perpendicular or vertical to the common joint.

The second groove 7 or the corresponding lateral border of the second groove 7 runs so that shifting board 1 relative to board 2 in a direction parallel to the joint results in the board 1 being simultaneously moved towards the other board 2. This movement continues until there is no more play.

The aforementioned way the groove runs is realized by a lateral wall 10 of the groove 7 running in a zigzag. FIG. 1A shows board 1 in a top view. The breadth of the groove 7 varies. The essential point is that the distance between the lateral border 10 of the groove 7 and the adjoining joint 4 varies. In this embodiment, the distance is of essence between the joint 4 and the wall 10 of the groove 7, which is located further away from the connecting joint 4 than the other lateral oblique wall 11 of the groove 7.

In this embodiment, the boards or panels are at first connected so that the one or more protruding locking elements 9 arrive in the second groove 7 in an area where there is a large distance between the wall 10 and the connecting joint 4. The distance reaches its maximum at the areas 12. When one of the boards 1 and 2 is now shifted in a parallel direction relative to the common joint 4, the protruding locking element 9 finally arrives in areas of the second groove 7, in which the lateral wall 10 is located at a smaller distance to the connecting joint 4. During shifting, the boards are forcibly and simultaneously moved towards each other until at last, play is eliminated. The final position is reached.

The aforementioned initial position can be provided by a rotary movement around the connecting joint 4. If the protruding lip 8 is elastic, the boards 1 and 2 can also be connected by shifting in one plane. In this case, the protruding elastic lip 8 has an incline 13 at its upper end. The lower end of the tongue 6 has a corresponding incline 14. The inclines facilitate the process of connecting when the boards 1 and 2 are to be brought into the initial position if they are not yet connected.

If the tongue 6 protrudes over the connecting joint to a lesser degree in comparison to the maximally possible play, panel 2 may, in the initial position, be totally separated from panel 1 by lifting in a vertical direction, if play is at its maximum. Making the initial position available is very easily effected by taking corresponding steps in a reverse order (starting with two panels 1 and 2 not being connected yet).

This embodiment is particularly easy to handle. Laying does not present a problem even if several oblong panels are already connected at their narrow side and are then to be connected collectively to a row of panels which have already been laid.

Several individual locking elements may be provided on the bottom side of the tongue. The distances between the individual locking elements are then brought into agreement with the distances between two areas 12.

Alternatively, a single oblong locking element can be provided which stretches across the whole length of the tongue. In this case, the wall 16 of the protruding locking element is also shaped in a zigzag or serpentine. The zigzag or serpentine of the wall 16 is brought into agreement with the way the wall 10 runs so that the aforementioned initial position and the final position can be assumed. The wall 10, together with the wall 16, form a contact area. There is play between the wall 10 and the wall 16 when the initial position has been assumed. This play is eliminated when the final position has been assumed.

In an embodiment of the invention which is not shown, further grooves may branch off from the second groove 7 in the direction of board 2 and be openly accessible at the end of the protruding flank 8. The grooves which branch off enter at the areas 12 or their vicinity. From the outside, protruding locking elements 9 may then be pushed through these branchings in the direction of the second groove 7. When they are level with the second groove 7, the board 1, for example, is shifted in a parallel direction relative to the connecting joint until the aforementioned initial position is reached. Further shifting in a parallel direction relative to the connecting joint results in the protruding locking elements 9 nearing the areas 15. The areas 15 are those regions of the lateral wall 10 of the groove 7 which have reached the closest proximity to the connecting joint 4. In this embodiment of the invention, the tongue 9 has a multitude of individual protruding locking elements.

In this case, the breadth of the locking elements has been brought into agreement with the breadth of the grooves leading to them.

The lateral wall 10 of the second groove 7, which is further away from the connecting joint in comparison with wall 11, preferably is at least partially shaped like an arch, namely at the areas 15, shown in FIG. 1B. The arch then runs so that the "center of the arch" is not "enclosed" by the connecting joint 4 of the arch. This means that, in the aforementioned final position, the protruding locking element 9 is located in an area of the second groove 7, which area in the area 15 approximates a parallel run of the wall 10, relative to the connecting joint 4. This is to counteract an unintended slipping back in the direction of the initial position, since the run is less steep in the direction of the initial position.

In an advantageous embodiment of the invention, an adhesive is provided in the area of the final position, such as, for example, in the areas 15. An unintended slipping back from the final position in the direction of the initial position, namely in the direction of the areas 12, is avoided by means of the adhesive.

The contact areas or the walls 10 and 16 which form the contact area between the protruding element 9 and the corresponding groove 7, run in a vertical direction relative to the surface of the boards 1 and 2.

Therefore, even if an elastic lip 8 is used, the connection is very firm in comparison with the subject matter of patent EP 843 763 B1, where an elastic lip with such a steeply inclined contact area is provided that it is conducive to slipping out.

In a further embodiment shown in FIG. 2, the walls 21 and 22 which form the contact area are formed in an undercut way. Though the contact area then again is oblique relative to the surface, the incline runs in an opposite direction compared to the oblique contact area which is contained in the subject matter of patent EP 843 763 B1. By means of this incline in the opposite direction, an indenting is effected in the final position, so that just by this means, a connection without the use of adhesives according to the invention is being made available. The laterally mounted tongue 6 as well as the corresponding laterally mounted groove 5 are, therefore, not essential for establishing a connection without the use of adhesives. Such an embodiment is to be preferred especially when tongue 6 is shorter than the maximum possible play which can occur between the walls 21 and 22, and thus at the connecting joint 4. If the tongue 6 is only of a very short length, it is very useful, for establishing a reliable connection, to provide an additional supporting interlock in a vertical direction relative to the surface.

In FIG. 1 as well as in FIG. 2, there are various cavities or recesses which serve in particular to receive excess adhesive or mass which is used as moisture protection.

If several separate locking elements 9 are provided, several separate second grooves 7 may also be provided. In that case, they need not run in a serpentine or zigzag. It suffices that they run in an arch or obliquely enough in relation to the joint 4, so that the aforementioned initial and the final position can be assumed.

Figure 3:
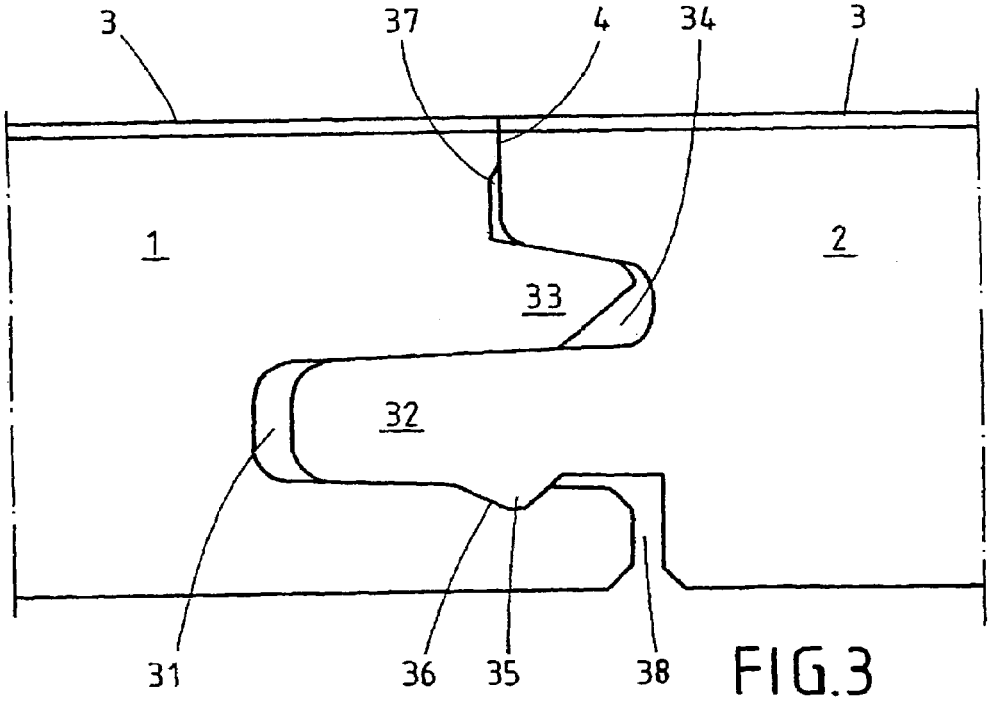
FIG. 3 is a schematic, fragmentary sectional view similar to FIG. 1 showing a connecting joint for the narrow or transverse sides of boards.

A further embodiment, in which play arises because board 2 may be lifted relative to board 1, is possible. Within the groove 5, then, there is a wave-like run of a lateral flank, and in a further embodiment there is an undercut, in analogy to FIG. 2. In FIG. 3, a connection is shown which, in addition to the connection according to FIGS. 1 and 2, is used especially at the narrow sides of oblong panels I and 2. This is the double tongue-and-groove connection already described. There is a first groove 31 of the board 1 which is located at the bottom and mounted laterally as well as a first tongue 32 of the board 2 which is located at the bottom and mounted laterally. Above the first lateral groove 31, an upper laterally mounted tongue 33 is provided. There is an upper, laterally mounted groove 34 on board 2 which corresponds with this. The two lateral or laterally mounted tongues narrow towards the open end, in order to facilitate being pushed into the respective lateral groove. The lateral grooves have a corresponding shape.

This means that they also narrow from the outside towards the inside. The upper lateral tongue 33 is shorter than the lower lateral tongue 32. The lower lateral tongue 32 is provided, on the bottom side, with a protruding locking element, which snaps into a groove 36 when the panels are in a connected state. The lower groove 36 runs in a vertical direction downward relative to the surface 3 and is mounted within the groove 31 at the lower flank.

The lateral walls of the groove 36 run in an incline so that the groove narrows in a downward direction. Correspondingly, the protruding locking element 35 narrows towards the open end. In particular, the incline which is located further towards the outside as seen from the groove 31 facilitates a connection without play being necessary. The locking elements 31, 32, 33 and 34 are brought into agreement with each other so that a cavity remains between the respective lateral tongue 32 and 33 on the one hand and the associated lateral grooves 31 and 34 on the other hand. The cavities serve the purpose of taking up excess adhesive or excess sealant. For the same reasons, a cavity above the tongue 33 and a recess 38 at the bottom side of the board are provided.

In an embodiment, the areas 16 and 10 have a corrugation so that the final position is locked by means of positive fit or by a kind of indenting.

The invention claimed is:

1. Boards with laterally mounted locking elements by means of which two of the boards may be interconnected by positive fit, characterized in that:

the locking elements are designed so that there is an initial position in which the boards are interlocked in a common plane by a positive fit in at least one direction and that there is play at a common joint formed by a joint surface on each of the two boards, said play comprising limited movement of the two boards in said common plane to space said joint surfaces, and there is a final position in which there is no play at the common joint and the boards are interlocked, said locking elements also including a surface extending in a direction along said common joint on each of said two boards, said surfaces being separated by a decreasing and increasing distance when said boards in said initial position are shifted in a direction parallel to said common joint, and said boards are relatively movable in a direction parallel to said common joint to engage said surfaces so as to bias said boards together and dispose said locking elements in said final position with no play at said common joint.

2. Boards according to claim 1, wherein each of said surfaces extends in a direction generally parallel with said common joint and said decreasing and increasing distance extends in a direction perpendicular to said common joint.

3. Boards according to claim 1, wherein said locking elements also include a tongue on one of said boards partially received within a groove on the other of said boards in said initial position to provide said positive fit in at least one direction, and engagement of said surfaces biases said tongue further into said groove and said joint surfaces into contact with no play at said common joint.

4. Boards having edges including laterally mounted locking elements which interconnect two of said boards to form a common joint with the boards disposed in a common plane, said common joint comprising a joint surface on each of the boards, said locking elements in an initial position including a tongue partially engaged within a groove so that the boards are interlocked in a positive fit that restricts relative movement of the boards in at least one direction, said locking elements also including a surface on each of said boards, said surfaces being spaced apart in said initial position to provide play including limited back and forth movement of the boards in a direction generally perpendicular to the common joint in said common plane to vary the spacing between said joint surfaces, and said locking elements being movable to a final position upon relative movement of the boards, in a direction parallel to said common joint, in said common plane, said surfaces engaging to bias the boards together in said final position so that there is no play at the common joint and the panels are interlocked with the joint surfaces in contact.

5. Boards according to claim 4, wherein said at least one direction extends perpendicular to said common plane.

6. Boards according to claim 5, wherein said surfaces are spaced apart a decreasing and increasing distance when said boards in said initial position are shifted in a direction parallel to said common joint.

* * * * *